US009061818B2

(12) United States Patent
Geiger

(10) Patent No.: US 9,061,818 B2
(45) Date of Patent: Jun. 23, 2015

(54) MEASURING AND MIXING TRAY WITH INDICIA

(71) Applicant: Four Front Design, Inc., Nokomis, FL (US)

(72) Inventor: Robert Geiger, Nokomis, FL (US)

(73) Assignee: Four Front Design, Inc., Nokomis, FL (US)

( * ) Notice: Subject to any disclaimer, the term of this patent is extended or adjusted under 35 U.S.C. 154(b) by 0 days.

(21) Appl. No.: 14/065,517

(22) Filed: Oct. 29, 2013

(65) Prior Publication Data

US 2014/0116517 A1 May 1, 2014

Related U.S. Application Data

(60) Provisional application No. 61/719,637, filed on Oct. 29, 2012.

(51) Int. Cl.

| | |
|---|---|
| ***B65D 81/32*** | (2006.01) |
| ***B65D 51/28*** | (2006.01) |
| ***B44D 3/06*** | (2006.01) |

(52) U.S. Cl.

CPC ..... *B65D 81/32* (2013.01); *B65D 51/28* (2013.01); *B44D 3/06* (2013.01)

(58) Field of Classification Search

CPC ..... B65D 51/28; B65D 81/32; B44D 3/06
USPC ..... 206/1.7–1.9, 459.5, 557–565, 575, 581; 434/81, 84, 98, 103
See application file for complete search history.

(56) References Cited

U.S. PATENT DOCUMENTS

| | | | | | |
|---|---|---|---|---|---|
| 748,026 | A | * | 12/1903 | Sussmilch | 206/1.7 |
| 1,474,721 | A | * | 11/1923 | King | 206/1.7 |
| 1,703,449 | A | * | 2/1929 | Huebner | 206/1.7 |
| 1,805,520 | A | * | 5/1931 | Grumbacher | 206/1.7 |
| 1,890,004 | A | * | 12/1932 | Schubert | 434/84 |
| 3,255,874 | A | * | 6/1966 | Elkner | 206/353 |
| 3,273,700 | A | * | 9/1966 | Moreau et al. | 206/1.7 |
| 3,491,875 | A | * | 1/1970 | Fischer et al. | 206/1.7 |
| 3,777,414 | A | * | 12/1973 | Robinson | 206/1.8 |
| 3,815,265 | A | * | 6/1974 | DePauw | 434/103 |
| 4,027,404 | A | * | 6/1977 | Brant | 206/1.8 |
| 4,911,642 | A | * | 3/1990 | Knowles | 434/84 |
| 5,209,664 | A | * | 5/1993 | Wilcox | 434/103 |
| 5,775,507 | A | * | 7/1998 | Wood | 206/564 |
| 5,792,422 | A | * | 8/1998 | Lin et al. | 206/562 |
| 6,802,715 | B1 | * | 10/2004 | Wotton | 434/81 |
| 7,351,783 | B1 | * | 4/2008 | Perala et al. | 528/27 |
| 2006/0283767 | A1 | * | 12/2006 | White West | 206/557 |

FOREIGN PATENT DOCUMENTS

DE 3423189 A1 * 1/1986

* cited by examiner

*Primary Examiner* — Bryon Gehman
(74) *Attorney, Agent, or Firm* — Fraser Clemens Martin & Miller LLC; William A. Ziehler

(57) ABSTRACT

A measuring and mixing tray includes a first well having a first predetermined volume for measuring a first component of a multicomponent system and a mixing portion. A method of measuring and mixing for the multicomponent system includes disposing the first predetermined volume of the first component in the first well of the measuring and mixing tray and transferring the first component from the first well to the mixing portion of the measuring and mixing tray.

20 Claims, 3 Drawing Sheets

MEASURING AND MIXING TRAY WITH INDICIA

CROSS-REFERENCE TO RELATED APPLICATIONS

This application claims priority to U.S. Provisional Application Ser. No. 61/719,637, filed Oct. 29, 2012. The entire disclosure of the above application is incorporated herein by reference.

FIELD OF THE INVENTION

The present technology relates to a tray for measuring and mixing a multicomponent system, and particularly to a measuring and mixing tray that provides volumetric measurements to obtain proper mixing ratios of the various components of the multicomponent system.

BACKGROUND OF THE INVENTION

This section provides background information related to the present disclosure which is not necessarily prior art.

Various multicomponent systems exist for fabrication or repair of various materials, including automobile and watercraft bodies and other applications. Such multicomponent systems can include two or more components that are mixed together. For example, one or more reactive materials can be mixed with one or more hardeners that react and form a solid material useful in various fabrication, filling, or repair processes. The reactive material can include one or more resins, polymers, or monomers and the like that have a semi-liquid, gel, paste, or putty-like consistency. The hardener can include a catalyst or cross-linker that also has a semi-liquid, gel, paste, or putty-like consistency. Other components can be included along with the reactive material and hardener, including various additives, fillers, and reinforcing materials, such as various polymers, fiberglass, and similar materials. Mixing the reactive component with the hardener transforms the mixture into a solid material often in a time-dependent manner. The resulting solid material can be further worked or shaped depending on the application, for example, where the solid material can be finished by sanding and painting.

The reactive component, for example, can include a resin or polymer that is hardened by chemical reaction with a catalyst. Such multicomponent systems, in this case a two-component system, are often used for fabrication, filling, or repair of automobile or watercraft bodies where it is impractical or impossible to use thermosetting materials. Other examples include two-part epoxy or polyester multicomponent systems that are used in automotive, marine, industrial, and household applications to repair and restore fiberglass, metal, aluminum, plastic, wood, concrete, brick, stone, asphalt, drywall, tile, and other such materials.

There are several commercial examples of multicomponent systems. Bondo® brand two-component systems manufactured by 3M (St. Paul, Minn.) and DOLPHIN FILLER™ brand two-component systems manufactured by U-POL (Nazareth, Pa.) are some examples. Such multicomponent systems can include a polyester resin that, when mixed with a hardener (e.g., an organic peroxide) or catalyst, turns into a putty which then sets and hardens. The mixed material is applied, sanded to the proper final shape, and can be primed and painted to match the surrounding material.

A problem often arises in mixing appropriate amounts of the reactive material and the corresponding hardener. Reaction and transformation of the reactive material once mixed with the hardener can be dependent on the ratio used. The time to harden and form a solid material, the efficiency of the hardening, and the stability of the resulting solid material can all be affected by the relative amounts of reactive material and hardener. Improperly mixed quantities can result in incompletely cured materials, where a desired hardness is not achieved (e.g., too little hardener), or where the resulting solid material shrinks over time (e.g., too much hardener). Such conditions can affect the integrity and/or adhesion of the solid material and its fitness in the chosen fabrication, filling, or repair process.

Mixing amounts of the reactive material and the hardener is typically performed by placing an amount of each on a surface of a palette, non-stick sheet, or piece of cardboard, or within a mixing cup or dish. Typically, a tool such as a putty knife is often used to transfer the amount of reactive material from its container to the surface. An amount of hardener is also squeezed out of its tube onto the same surface. The reactive material and the hardener are then mixed together using a spreader or the putty knife to blend and spread the combined mass back and forth on the surface to thoroughly mix the reactive material and the hardener together. The mixed material is then applied and shaped as needed. Hardening can occur within seconds to minutes to hours, depending on the amounts and types of components employed. Upon hardening, the solid material is often finished by sanding, sealing, and painting.

However, ratios of the various components of the multicomponent systems that are mixed together are often not the optimal or manufacturer recommended amounts. For example, the reactive material and the hardener can each have semi-liquid, gel, paste, or putty-like consistency that cannot be easily poured into a measuring cup, for example. As a consequence, a user typically guesses how much reactive material and hardener are appropriate, where the estimated amounts often result in a non-optimal ratio of reactive material to hardener. The result can be incompletely cured materials where a desired hardness is not achieved or the resulting solid material can subsequently shrink over time. In each case, the incorrectly mixed reactive material and hardener compromise the integrity and/or adhesion of the resulting solid material and its fitness in the subject fabrication, filling, or repair process. Furthermore, when materials having a porous surface are employed for mixing, such as cardboard, the hardener in certain components can be absorbed into the cardboard, which can further contribute to a less than optimal final mixture and improperly formed final product.

Given the importance of having a multicomponent system with proper mix ratios of components and the need to mix components together in an efficient manner with minimal effort, it would be advantageous if an apparatus, kit, and method for measuring and mixing components of multicomponent systems could be provided.

SUMMARY OF THE INVENTION

Concordant and congruous with the present invention, an improved apparatus, kit, and method for measuring and mixing components of a multicomponent system has surprisingly been discovered.

In an embodiment of the invention, a measuring and mixing tray is provided. The measuring and mixing tray includes a first well and a mixing portion. The first well has a first predetermined volume for measuring a first component of a multicomponent system. The mixing portion is configured to accommodate at least the first predetermined volume of the first component of the multicomponent system. The first predetermined volume of the first component can be mixed with a second component in the mixing portion.

In another embodiment of the invention, a kit includes a container of a first component of a multicomponent system and a measuring and mixing tray. The mixing and measuring tray comprises a first well and a mixing portion. The first well has a first predetermined volume for measuring the first component of the multicomponent system. The mixing portion is configured to accommodate at least the first predetermined volume of the first component of the multicomponent system. The kit can further include a container of a second component and a cap configured to contain the measuring and mixing tray and the container of the second component by releasably coupling the cap to the container of the first component.

In a further embodiment of the invention, a method of measuring and mixing for a multicomponent system is disclosed. The method includes providing a measuring and mixing tray comprising a first well and a mixing portion. The first well has a first predetermined volume for measuring the first component of the multicomponent system. The mixing portion is configured to accommodate at least the first predetermined volume of the first component of the multicomponent system. The first component is disposed in the first well of the measuring and mixing tray to provide the first predetermined volume of the first component. The first predetermined volume of the first component is transferred from the first well to the mixing portion of the measuring and mixing tray. A second predetermined volume of a second component of the multicomponent system can be mixed with the first component.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION OF EXEMPLARY EMBODIMENTS OF THE INVENTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding the methods disclosed, the order of the steps presented is exemplary in nature, and thus, the order of the steps can be different in various embodiments. Except where otherwise expressly indicated, all dimensions and numerical quantities in this description are to be understood as modified by the word "about" in describing the broadest scope of the technology.

Figure 1:
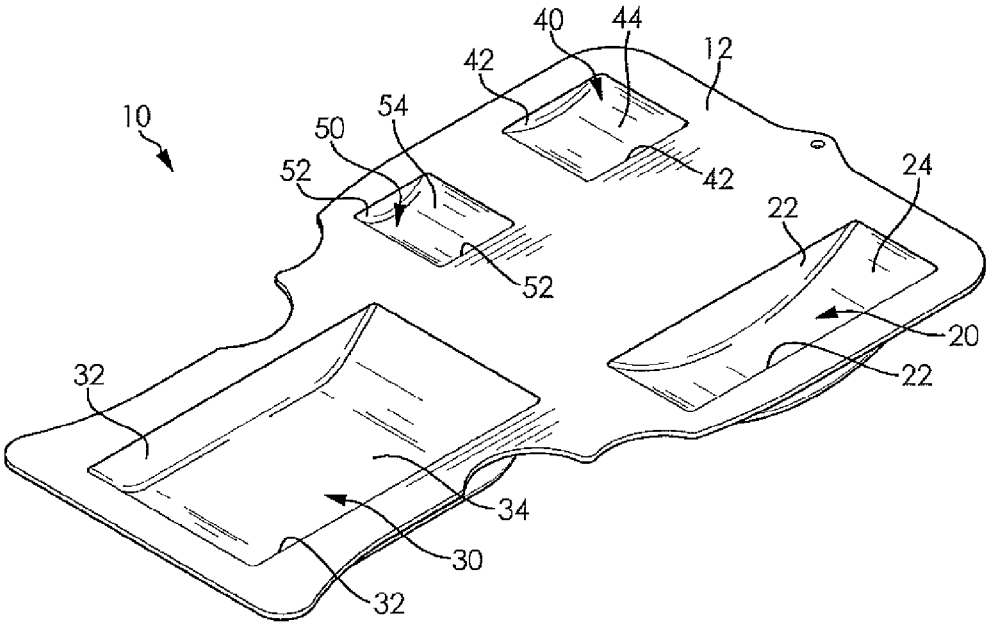
FIG. 1 is a top perspective view of a measuring and mixing tray according to an embodiment of the invention.
Figure 2:
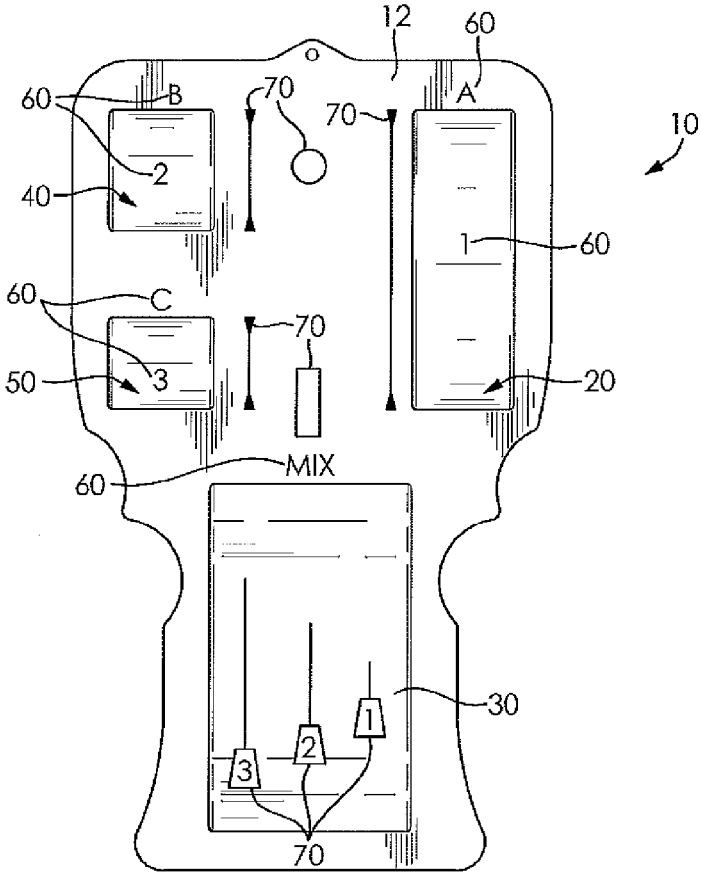
FIG. 2 is a top plan view of the measuring and mixing tray of FIG. 1.
Figure 3:
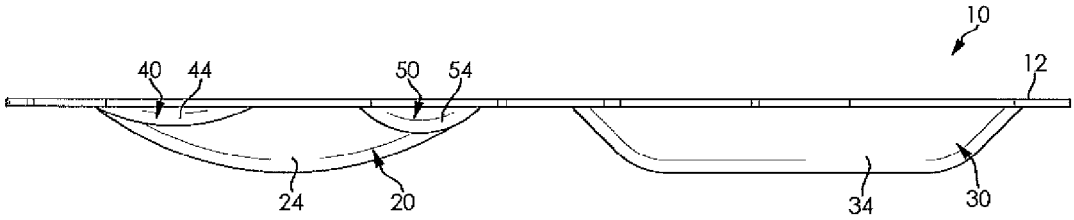
FIG. 3 is a left side elevational view of the measuring and mixing tray of FIG. 1.

FIGS. 1-3 illustrate a measuring and mixing tray 10 that accurately measures by volume one or more components of a multicomponent system according to an embodiment of the invention. The multicomponent system can be any system of two or more components that can be mixed together to form various materials for any application as desired. For example, the multicomponent systems can include polyester, vinyl ester, epoxy, and other two or three component systems. The components of the multicomponent system can include one or more reactive materials, hardeners, and optionally, additives to form materials used in fabrication, filling, or repair processes. The reactive material can include one or more resins, polymers, or monomers and the like that can have a semi-liquid, gel, paste, or putty-like consistency. The hardener can include a catalyst such as benzyl peroxide or a cross-linker that can have a semi-liquid, gel, paste, or putty-like consistency. An additive can be optionally included such as various polymers, fiberglass or other reinforcing materials, UV stabilizers, and similar materials. The multicomponent systems can have any number of components as desired for any type of application that may require measuring and mixing.

The tray 10 includes a first well 20. The first well 20 has a defined volume that is at least equal to a predetermined volume of a first component of a multicomponent system, where the predetermined volume facilitates providing a proper mix ratio for a multicomponent system. For example, the first well 20 can have a defined volume for containing a volume of reactive material or a volume of hardener. The first well 20 formed in the tray 10 can include two straight walls 22 and a curved wall 24. The curved wall 24 can extend between the two straight walls 22. As shown in FIG. 3, the first well 20 has an arcuate cross-sectional shape that is concave in relation to a surface 12 of the tray 10. The first well 20 can have any number of walls and any cross-sectional shape as desired, including various geometric shapes such as rectangular, triangular, trapezoidal, or any other shape to facilitate measuring and mixing. Additionally, the curved wall 24 can have a width corresponding to a width of an end of a tool, such as a putty knife. The width and shape of the curved wall facilitate scooping and removing substantially all of the component from the first well 20 with a tool, such as a putty knife, with minimal effort.

The tray 10 also includes a mixing portion 30 where the first component and one or more additional components of the multicomponent system are mixed, such as mixing the hardener and the reactive material. The mixing portion 30 can receive and accommodate at least the predetermined volume of the first component in the first well 20 and any other components that may be mixed with the component from the first well 20. The mixing portion 30 can be disposed on the surface 12 of the tray 10 having an area such that all the components of the multicomponent system can be mixed together. In an embodiment of the invention, the mixing portion 30 is a mixing well formed in the tray 10, separate from the first well 20, having a volume to receive and accommodate one, two, three, or more components of the multicomponent system. The mixing portion 30 can have two straight walls 32 and a curved wall 34 to form a mixing portion 30 that has a substantially trapezoidal cross-sectional shape, as shown in FIG. 3. However, the mixing portion 30 can have any number of walls and any cross-sectional shape as desired such as rectangular, triangular, arcuate, or any other shape to facilitate measuring and mixing. Like the first well 20, the curved wall 34 of the mixing portion 30 can have a width and shape to facilitate scooping and removing substantially all of the mixed components from the mixing portion 30 with a tool, such as a putty knife, with minimal effort.

The tray 10 can further include a second well 40. The second well 40 has a defined volume that is at least equal to a predetermined volume of a second component of a multicomponent system, where the predetermined volume facilitates providing a proper mix ratio for a multicomponent system. For example, the second well 40 can have a defined volume for containing a defined volume of the reactive material or a defined volume of the hardener. The second well 40 is formed in the tray 10 and can have two straight walls 42 and a curved wall 44. The curved wall 44 extends between the two straight walls 42. As shown in FIG. 3, the second well 40 has an arcuate cross-sectional shape that is concave in relation to a surface 12 of the tray 10. The second well 40 can have any number of walls and any cross-sectional shape as desired such as rectangular, triangular, trapezoidal, or any other shape to facilitate measuring and mixing. Additionally, the curved wall 44 can have a width corresponding to a width of an end of a tool, such as a putty knife. The width and shape of the curved wall 44 facilitate scooping substantially all of the second component from the second well 40 with a tool, such as a putty knife, with minimal effort.

Each of the first well 20 and the second well 40 have volumes configured for various multicomponent systems to provide particular component mixing ratios. The first well 20 can have a volume configured to provide a desired volume of a first component and the second well 40 can have a volume configured to provide a desired volume of a second component. For example, the first well 20 can be configured for the reactive material and the second well 40 can be configured for the hardener of a multicomponent system. As one example, the first well 20 and the second well 40 can have the same volume to provide a 1:1 mixing ratio. In other embodiments of the invention, the volumes of the first well 20 and the second well 40 can be configured to provide a 2:1 reactive material to hardener mixing ratio or a 3:1 reactive material to hardener mixing ratio. The predetermined volumes of the first well 20 and the second well 40 can also be configured to provide any desired mixing ratio of any components for various multicomponent systems.

The tray 10 can further include a third well 50. The third well 50 has a defined volume that is at least equal to a predetermined volume of a third component of a multicomponent system, where the predetermined volume facilitates providing a proper ratio for a multicomponent system. For example, the third well 50 can have a defined volume for containing a defined volume of a third component, such as an additive for the reactive material and hardener mixture. The third well 50 is formed in the tray 10 and can have two straight walls 52 and a curved wall 54. The curved wall 54 extends between the two straight walls 52. As shown in FIG. 3, the third well 50 has an arcuate cross-sectional shape that is concave in relation to a surface 12 of the tray 10. The third well 50 can have any number of walls and any cross-sectional shape as desired such as rectangular, triangular, trapezoidal, or any other shape to facilitate measuring and mixing. Additionally, the curved wall 54 can have a width corresponding to a width of an end of a tool, such as a putty knife. The width and shape of the curved wall 54 facilitate scooping substantially all of the component from the third well 50 with a tool, such as a putty knife, with minimal effort.

Where a third well is provided, each of the first well 20, the second well 40, and the third well 50 can have volumes configured for various multicomponent systems to provide particular component mixing ratios. For example, the first well 20 can be configured for the reactive material, the second well 40 can be configured for the hardener, and the third well 50 can be configured for the additive of a multicomponent system. In this example, the first well 20, the second well 40, and the third well 50 can have the same volume to provide a 1:1:1 mixing ratio. In other embodiments of the invention, the volumes of the first well 20, the second well 40, and the third well, can be configured to provide a 3:2:1 reactive material to hardener mixing ratio. The first well 20, the second well 40, and the third well 50 can also be configured to provide any desired ratios of any components of a multicomponent system as desired.

Likewise, the first well 20, the second well 40, and the third well 50 can be configured to have volumes that correspond to ratios dependent on a particular application. For example, the first well 20 can have a volume for a component desired for a filling application, the second well 40 can have a volume for a component desired for a fabrication application, and the third well 50 can have a volume for a component desired for a repair application. Additionally, in another example, the first well 20 can be configured to provide a volume for a reactive material and the second well 40 can be configured to provide a volume of the hardener for a larger application while the third well 50 can be configured to provide a volume of the hardener alternate from the second well 40 for a minor application where less mixed material may be needed or a different multicomponent system or chemistry is employed. It is understood that the tray 10 can further include a fourth well, fifth well, sixth well, or any amount of wells as desired. Each of the wells can be configured to have any volumes as desired to correspond to various mixing ratios for various multicomponent systems and to provide various total amounts of mixed components for various multicomponent systems. In the examples where two or more wells are provided, the mixing portion 30 can have a volume equal to at least the sum of the wells so that all the measured components can fit therein and be mixed in the mixing portion 30.

As shown in FIG. 2, the tray 10 can include indicia 60 marking the first well 20, the second well 40, the third well 50, and the mixing portion 30. The indicia 60 can include numbers, letters, symbols, descriptions, colors, or instructions to be used to identify the various wells 20, 40, 50 and mixing portion 30. The indicia 60 can be marked on the surface 12 of the tray 10 or within the wells 20, 40, 50 and the mixing portion 30. In a non-limiting example, the surface 12 of the tray 10 adjacent the first well 20 can be labeled "A" to correspond to a reactive material and the surface 12 adjacent the second well 40 can be labeled "B" to correspond to a hardener. Furthermore, words, such as "first component," "reactive material," and "mix," can be used to mark the tray 10. The wells 20, 40, 50 and/or the mixing portion 30 can also be color coded to match colors of the various components and/or container colors of the multicomponent system. An instruction set can also be included to direct a user of the tray 10 on how to measure and mix the various components.

With continuing reference to FIG. 2, one or more indicia 70 can also be included that is used to mark the amount of a component dispensed onto the tray 10 such as a length of a stripe or bead or a spot of a component being dispensed from a tube. The indicia 70 can be marked on the surface 12 of the tray 10 or within the wells 20, 40, 50 or within the mixing portion 30. For example, a tube of hardener can be used to squeeze an amount of hardener along a line marked on the tray 10. The substantially constant cross-section of the stripe of hardener gives a substantially defined amount of material per length. The stripe of hardener overlaid on the line provides an amount of hardener needed to mix with another component to provide desired mixing ratios. The other component could be a reactive material already measured, such as being measured by filling a well 20, 40, 50 in the tray 10. More than one indicia 70 can be provided such as lines with varying lengths, where each line corresponds to varying amounts of the component needed to obtain varying mixing ratios. Additionally, the indicia 70 can be any symbol as desired, such as a straight line, curved line, rectangle, circle, or combination of symbols, for example. The indicia 70 can also include numbers, symbols, letters, descriptions, and instructions to guide or instruct a user on how to dispense the components of the multicomponent system.

The surface 12 of the tray 10 can be substantially planar with the top of the first well 20, second well 40, and/or third well 50, including the mixing portion 30 when configured as a mixing well. In this manner, one or more wells 20, 40, 50 can be filled with component(s) and the amount of the component(s) leveled off to the plane of the tray 10 surface 12. A tool having a width greater than the various wells 20, 40, 50 can be used to wipe across the surface 12 of the tray 10 and remove excess component(s) rising above the plane of the surface 12, thereby providing accurate amounts of component(s) corresponding to the respective predetermined volume(s) of the wells 20, 40, 50.

The tray 10 can be contoured to facilitate a grip by a user. For example, various finger notches can be placed on the outside edge of the tray 10 and/or one or more finger and/or thumb holes or handles (not shown) can be placed within or projecting from the tray 10 to optimize ergonomic aspects of the tray 10. The surface 12 of the tray 10 and the wells 20, 40, 50 can also have a substantially non-stick and non-porous surface to militate against components sticking or absorbing to the tray 10. The tray 10 can be made from any material as desired, such as plastic or metal, for example. The tray 10 can be manufactured in various ways, such as injection molded, vacuum molded, pressed, stamped, rolled, among other forming methods. Likewise, the wells 20, 40, 50 and mixing portion 30 can be integrally formed with the tray 10 or formed separately from the tray 10 and attached thereto.

In use of the tray 10, the user places a first component in the first well 20 to fill the first well 20 and obtain the predetermined volume thereof. By placing the first component in the first well 20, the user does not have to guess the proper amount nor weigh the first component. Once the first well 20 is filled with the first component, the first component can be transferred from the first well 20 to the mixing portion 30 of the tray 10. A second component can then be added to the mixing portion 30 to mix with the first component. Where the indicia 70 is provided, the second component can be dispensed onto the indicia 70 to obtain a proper measurement of the second component before adding the second component to the mixing portion 30.

In the embodiment of the invention including more than one well, such as at least the first well 20 and the second well 40, the first component is placed in the first well 20 to fill the first well 20 to obtain a predetermined volume. The second component is placed in the second well 40 to fill the second well 40 to obtain a predetermined volume. The first component is then transferred from the first well 20 to the mixing portion 30 and the second component is transferred from the second well 40 to the mixing portion 30 to be mixed together. For example, the first component can be the reactive material and the second material can be the hardener. If the tray 10 includes the third well 50, a third component is placed into the third well 50 to fill the third well 50 to obtain a predetermined volume. The third component is then transferred to the mixing portion 30 to be mixed with the first component and the second component. It is understood the tray 10 can include any number of wells for measuring components, in which the wells can be filled with any component as desired to obtain a predetermined volume and subsequently transferred to the mixing portion 30 to be mixing with other components of the multicomponent system.

Figure 4:
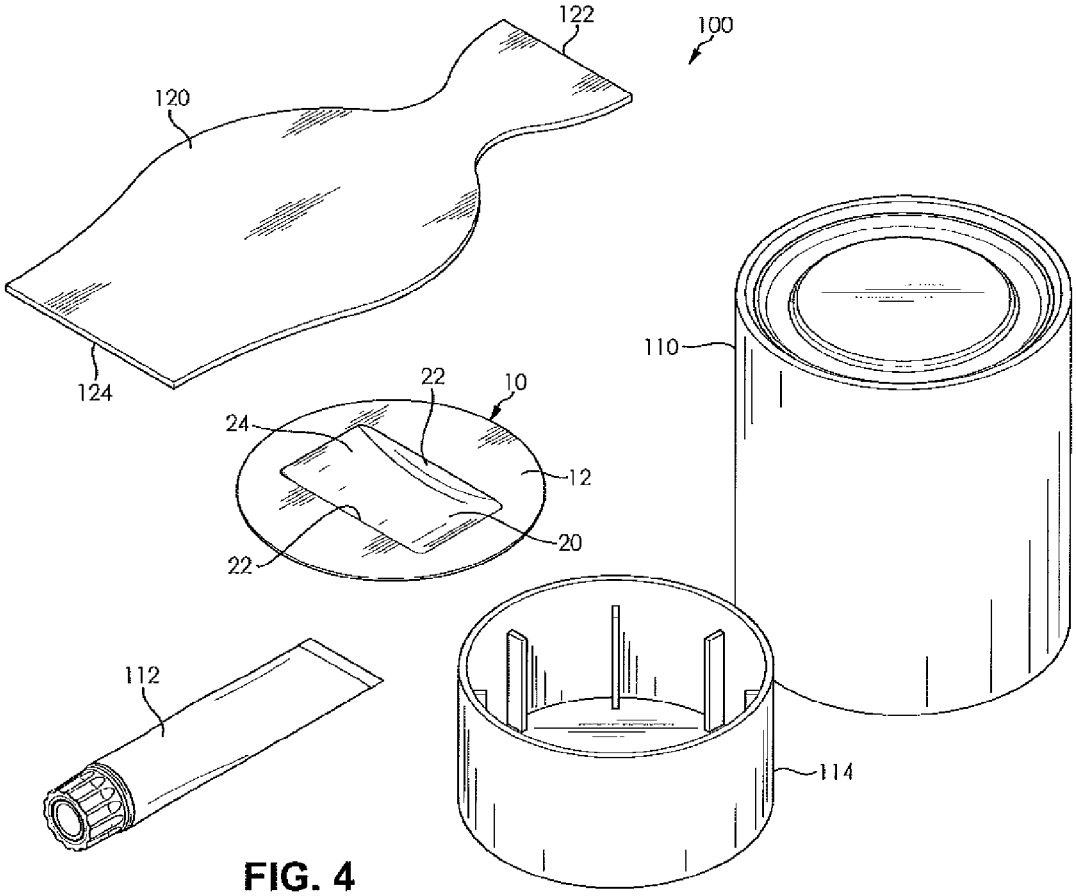
FIG. 4 is a kit according to an embodiment of the present invention.

As shown in FIG. 4, a kit 100 according to an embodiment of the invention is illustrated. The kit 100 can include the measuring and mixing tray 10, a container of a first component 110, a container of a second component 112, a cap 114, and a tool 120. The tray 10 illustrated has one well. However, the tray 10 can have more than one well and can comprise any of the embodiments of the tray 10 described herein. The container of the first component 110 contains the first component of a multicomponent system and the container of the second component 112 contains the second component. In a non-limiting example, the container of the first component 110 can be a can of reactive material including filler and the container of the second component 112 can be a tube of hardener. The cap 114 can be releasably coupled to the container of the first component 110. The container of the second component 112 and the tray 10 can be contained within the cap 114 when the cap is coupled to the container of the first component 110. In another embodiment of the invention, the tray 10 can be configured to be a cap. For example, the tray 10 in FIG. 4 can form a top portion of the cap 114; i.e., where the first well 20 (and any other aspects of the tray 10 as provided herein) are formed into the cap 114.

In FIG. 4, a tool 120 is shown as being included in the kit 100. However, the tool 120 can be separate from the kit 100 as well. The tool 120 can include ends 122, 124 of varying widths that correspond to varying widths of the wells 20, 40, 50 on the tray 10 to allow substantially the entire volume of the component in the corresponding well to be swept in a single pass. For example, the end 122 can have a width equal to the width of the first well 20 and the end 124 can have a width equal to the second well 40 and/or the mixing portion 20 when configured as a mixing well. In particular, one of the ends 122, 124 can be used to add material to the wells 20, 40, 50 and remove material from the wells 20, 40, 50, as well as, mix a material on the tray 10. The tool 120 can be contoured to facilitate a grip by a user. Various materials can be used to form the tool 120, such as plastic or metal, for example. The tool 120 can also be made of the same material as the tray 10 so the tool does not scratch or gouge the tray 10. Scratches and gouges can cause cured and uncured components to become entrapped in the tray 10.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A measuring and mixing tray for measuring and mixing a multicomponent system comprising:

a first well having a first predetermined volume for measuring a corresponding first predetermined volume of a first component of the multicomponent system;

a mixing portion configured to accommodate at least the first predetermined volume of the first component of the multicomponent system; and a first indicia marking a dispensing area for a second component of the multicomponent system, the first indicia indicating a first substantially defined volume of the second component when a bead of known cross-sectional dimension of the second component is dispensed along the first indicia, the first substantially defined volume of the second component providing a desired mixing ratio with the first predetermined volume of the first component.

2. The measuring and mixing tray of claim 1, wherein the first well has two straight walls and one curved wall.

3. The measuring and mixing tray of claim 2, wherein the curved wall is disposed between the two straight walls.

4. The measuring and mixing tray of claim 1, wherein the mixing portion is a mixing well.

5. The measuring and mixing tray of claim 1, further comprising;

a second well having a second predetermined volume for measuring a corresponding second predetermined volume of the first component of the multicomponent system; and a second indicia marking a dispensing area for the second component of the multicomponent system, the second indicia indicating a second substantially defined volume of the second component when a bead of known cross-sectional dimension of the second component is dispensed along the second indicia, the second substantially defined volume of the second component providing a desired mixing ratio with the second predetermined volume of the first component.

6. The measuring and mixing tray of claim 5, wherein the mixing portion is configured to independently accommodate the first predetermined volume of the first component and the second predetermined volume of the second component.

7. The measuring and mixing tray of claim 5, further comprising:

a third well having a third predetermined volume for measuring a corresponding third predetermined volume of the first component of the multicomponent system; and a third indicia marking a dispensing area for the second component of the multicomponent system, the third indicia indicating a third substantially defined volume of the second component when a bead of known cross-sectional dimension of the second component is dispensed along the third indicia, the third substantially defined volume of the second component providing a desired mixing ratio with the third predetermined volume of the first component.

8. The measuring and mixing tray of claim 1, wherein the first indicia is located in the mixing portion.

9. The measuring and mixing tray of claim 1, wherein the tray has a surface that is substantially non-stick and non-porous.

10. The measuring and mixing tray of claim 1, wherein the first indicia comprises a line.

11. The measuring and mixing tray of claim 1, wherein the first indicia is adjacent to the first well.

12. A kit for measuring and mixing a multicomponent system comprising:

a container of a first component of the multicomponent system; and a measuring and mixing tray comprising a first well, a mixing portion, and a first indicia, the first well having a first predetermined volume for measuring a corresponding first predetermined volume of the first component of the multicomponent system, the mixing portion configured to accommodate at least the first predetermined volume of the first component of the multicomponent system, and the first indicia marking a dispensing area for a second component of the multicomponent system, the first indicia indicating a first substantially defined volume of the second component when a bead of known cross-sectional dimension of the second component is dispensed along the first indicia, the first substantially defined volume of the second component providing a desired mixing ratio with the first predetermined volume of the first component.

13. The kit according to claim 12, further comprising a container of a second component of the multicomponent system, wherein one of the first component and the second component is a reactive component and the other of the first component and the second component is a hardener.

14. The kit according to claim 12, wherein the measuring and mixing tray is a cap configured to reversibly couple to the container of the first component.

15. The kit according to claim 12, further comprising a cap configured to receive the mixing and measuring tray, the cap configured to reversibly couple to the container of the first component.

16. The kit according to claim 12, further comprising a tool having an edge substantially the same width of at least the first well.

17. The kit according to claim 12, wherein the first indicia comprises a line.

18. A method of measuring and mixing a multicomponent system comprising the steps of:

providing a measuring and mixing tray comprising a first well, a mixing portion, and a first indicia, the first well having a first predetermined volume for measuring a corresponding first predetermined volume of a first component of the multicomponent system, the mixing portion configured to accommodate at least the first predetermined volume of the first component of the multicomponent system, and the first indicia marking a dispensing area for a second component of the multicomponent system, the first indicia indicating a first substantially defined volume of the second component when a bead of known cross-sectional dimension of the second component is dispensed along the first indicia, the first substantially defined volume of the second component providing a desired mixing ratio with the first predetermined volume of the first component;

disposing the first component in the first well of the measuring and mixing tray to provide the first predetermined volume of the first component;

dispensing a second component on or along the first indicia to provide the first substantially defined volume of the second component; and transferring the first predetermined volume of the first component from the first well to the mixing portion of the measuring and mixing tray.

19. The method according to claim 18, further comprising mixing the first substantially defined amount of the second component of the multicomponent system with the first predetermined volume of the first component.

20. The method according to claim 19, wherein the mixing transforms the mixture into a solid material in a time-dependent manner.

* * * * *